US010076195B2

(12) United States Patent
Winikoff

(10) Patent No.: US 10,076,195 B2
(45) Date of Patent: Sep. 18, 2018

(54) DISPLAY RACK

(71) Applicant: Robert Winikoff, Montreal (CA)

(72) Inventor: Robert Winikoff, Montreal (CA)

( * ) Notice: Subject to any disclaimer, the term of this patent is extended or adjusted under 35 U.S.C. 154(b) by 0 days.

(21) Appl. No.: 15/717,852

(22) Filed: Sep. 27, 2017

(65) Prior Publication Data

US 2018/0084928 A1 Mar. 29, 2018

(51) Int. Cl.

| | |
|---|---|
| ***A47F 7/00*** | (2006.01) |
| ***A47F 5/13*** | (2006.01) |
| ***A47F 5/00*** | (2006.01) |
| ***G09F 23/00*** | (2006.01) |
| ***G09F 7/18*** | (2006.01) |
| *A47F 8/00* | (2006.01) |
| *A47F 7/24* | (2006.01) |
| *A47G 25/06* | (2006.01) |

(52) U.S. Cl.

CPC ..... *A47F 5/13* (2013.01); *A47F 5/0043* (2013.01); *G09F 7/18* (2013.01); *G09F 23/00* (2013.01); *A47F 7/24* (2013.01); *A47F 8/00* (2013.01); *A47G 25/06* (2013.01); *G09F 2007/1856* (2013.01)

(58) Field of Classification Search

CPC .... A47G 25/06; A47G 25/0678; A47G 25/14; A47G 25/0685; A47F 7/19; A47F 5/0043; A47F 5/13; A47F 8/00; A47F 7/24; G09F 23/00; G09F 7/18; G09F 2007/1856

USPC ..... 211/85.3, 193, 196, 124, 123, 189, 207, 211/204, 13.1, 205, 197, 133.4; 248/415, 248/222.14, 158, 125.1, 121, 122.1, 248/123.11, 161, 125.8; 223/120

See application file for complete search history.

(56) References Cited

U.S. PATENT DOCUMENTS

| | | | | | |
|---|---|---|---|---|---|
| 23,941 | A * | 5/1859 | Nutting | A47G 25/0664 | 211/196 |
| 211,851 | A * | 2/1879 | Jacobs | A47F 5/12 | 211/166 |
| 351,373 | A * | 10/1886 | Gordon | D06F 57/04 | 211/197 |
| 752,203 | A * | 2/1904 | Cook | A47F 5/103 | 211/106.01 |
| 882,960 | A * | 3/1908 | Peterson | D06F 57/04 | 211/115 |
| 1,111,304 | A * | 9/1914 | Forester | A47F 5/103 | 211/106.01 |
| 2,165,915 | A * | 7/1939 | Berger | A47F 5/02 | 211/85.3 |

(Continued)

*Primary Examiner* — Abigail E Troy
*Assistant Examiner* — Devin K Barnett
(74) *Attorney, Agent, or Firm* — Praxis

(57) ABSTRACT

A display rack for displaying articles comprises a base, a vertical post assembly mounted to the base and upstanding therefrom and at least one article holding assembly removably mounted to the vertical post assembly. The article holding assembly comprises a longitudinal mounting arm extending downwardly and away from the vertical post assembly. A pair of longitudinal carrier arms are mounted to the longitudinal mounting arm and extend rearwardly and away from the longitudinal mounting arm and from each other. At least one hanger element is movably mounted to one of the pair of longitudinal carrier arms and extends away from the carrier arm. The hanger element is movable along a longitudinal length of the carrier arm. The hanger element provides for mounting articles thereto to be displayed.

11 Claims, 13 Drawing Sheets

(56) References Cited

U.S. PATENT DOCUMENTS 2,810,212 A * 10/1957 Sturmer ..... A47F 7/10 223/120
3,194,409 A * 7/1965 Midouhas ..... D06F 57/04 211/197
3,424,317 A * 1/1969 Singer ..... A47G 25/0678 211/167
3,533,513 A * 10/1970 Berman ..... A47F 5/14 211/175
3,692,188 A * 9/1972 Bayne ..... A47F 7/24 211/49.1
3,921,814 A * 11/1975 Solomon ..... A47F 7/24 211/124
3,984,002 A * 10/1976 Howard ..... A47F 5/01 16/87.2
4,253,578 A * 3/1981 Rekow ..... A47F 5/04 211/204
4,316,547 A * 2/1982 Varon ..... A47G 25/0692 211/105.1
4,351,441 A * 9/1982 Schramm ..... A47F 7/24 211/182
4,361,241 A * 11/1982 Stoddard ..... A47F 7/24 211/123
4,380,298 A * 4/1983 Harig ..... A47F 5/13 211/182
4,474,299 A * 10/1984 Andrews ..... A47F 7/24 211/123
4,655,354 A * 4/1987 Cohen ..... A47F 5/108 211/199
D294,543 S * 3/1988 Rekow ..... D6/681.3
4,770,303 A * 9/1988 Boyd ..... A47G 7/042 211/118
4,813,552 A * 3/1989 Walter ..... A47F 5/08 211/105.1
4,958,738 A * 9/1990 Lee ..... A47F 7/19 211/106.01
4,981,227 A * 1/1991 Ingram ..... A47B 57/06 211/123
5,014,862 A * 5/1991 Bustos ..... A47F 5/103 211/189
5,056,670 A * 10/1991 Fine ..... A47B 61/003 211/85.3
5,103,984 A * 4/1992 Leyden ..... A47F 5/0861 211/4
5,170,898 A * 12/1992 Katz ..... A47B 57/54 211/193
D333,741 S * 3/1993 Katz ..... D6/681.1
5,305,890 A * 4/1994 Ishikawa ..... A47F 7/24 211/122
5,439,120 A * 8/1995 Brozak ..... A47F 5/0838 206/806
5,503,312 A * 4/1996 Kassner ..... A47F 7/065 211/182
6,053,460 A * 4/2000 Wilkinson, Jr. ..... A47F 5/105 211/193
6,056,254 A * 5/2000 Albright ..... F16B 7/0406 223/120
6,213,434 B1 * 4/2001 Reichanadter, Jr. ..... A47F 5/06 211/207
D450,473 S * 11/2001 Walter ..... D6/681.1
D451,300 S * 12/2001 Stafford ..... D6/681.1
6,390,311 B1 * 5/2002 Belokin ..... A61M 5/1415 211/189
D463,679 S * 10/2002 Chang ..... D6/681.3
6,726,033 B2 * 4/2004 Sparkowski ..... A47F 13/085 211/196
D503,046 S * 3/2005 Caiazzo ..... A47G 25/06 D6/327
6,959,824 B1 * 11/2005 Alperson ..... A47F 5/137 211/1.3
D571,131 S * 6/2008 Clark ..... D6/702
7,770,743 B1 * 8/2010 Janowak ..... A47G 7/042 108/92
8,579,126 B1 * 11/2013 Cole ..... A47F 7/0071 211/175
8,763,824 B2 * 7/2014 Alcock ..... A47G 25/0664 211/206
8,820,547 B2 * 9/2014 Hayashida ..... A47B 96/00 211/162
8,955,692 B2 * 2/2015 Greenway ..... D06F 57/04 211/1.53
9,713,398 B2 * 7/2017 Xavier da Silva .... A47G 25/14
9,918,568 B1 * 3/2018 Blake ..... A47B 57/545
2003/0196980 A1 * 10/2003 Ahn ..... A47F 5/137 211/189
2004/0055982 A1 * 3/2004 Jennings ..... A47F 3/14 211/126.2
2004/0112854 A1 * 6/2004 Lai ..... A47G 25/0664 211/206
2005/0077326 A1 * 4/2005 Poindexter ..... A47F 5/04 223/85
2006/0054576 A1 * 3/2006 Durham ..... A47L 23/205 211/85.7
2006/0118505 A1 * 6/2006 Walter ..... A47F 5/08 211/190
2007/0175848 A1 * 8/2007 Mallen ..... A47G 25/0671 211/196
2007/0272642 A1 * 11/2007 Baptiste ..... A47B 43/00 211/201
2009/0283485 A1 * 11/2009 Anderson ..... A47F 7/06 211/85.3
2011/0036794 A1 * 2/2011 Schott ..... A47G 25/0671 211/85.3
2011/0114586 A1 * 5/2011 Guzy ..... A47B 47/00 211/190
2014/0124465 A1 * 5/2014 Penner ..... A47G 25/08 211/85.3
2014/0252047 A1 * 9/2014 Clark ..... A47F 5/10 223/84
2014/0259831 A1 * 9/2014 Denby ..... A47F 5/10 40/606.03
2015/0282614 A1 * 10/2015 Wyner ..... A47B 61/003 211/85.3
2016/0135616 A1 * 5/2016 Fisher ..... A47F 5/0006 211/13.1

* cited by examiner

DISPLAY RACK

TECHNICAL FIELD

The present application claims priority on Canadian Patent Application No. 2,943,123 filed on Sep. 27, 2016, which is incorporated herein by reference in its entirety.

TECHNICAL FIELD

The present disclosure relates to a display rack.

BACKGROUND

Store display racks for displaying clothes and other articles are well known in the art. Many of these racks need to be completely disassembled when replacing hangers. Conventional display racks are not easily upwardly extendible while clothes are currently displayed thereon. Stores seek ways of adding more clothing to display racks as well as adding more accessories without making them burdensome or difficult to use since assembly and dissambly is labour intensive.

OBJECTS

It is an object of the present disclosure to provide a display rack.

It is an object of the present disclosure to provide a kit of a display rack.

SUMMARY

In accordance with an aspect of the present disclosure, there is provided a display rack for displaying articles comprising: a base for being positioned on a surface; a vertical post assembly mounted to the base at a bottom portion thereof and upstanding therefrom and defining a top portion thereof; at least one article holding assembly removably mounted to the vertical post assembly at the top portion thereof, the article holding assembly comprising: a longitudinal mounting arm mounted at one end thereof to the vertical post assembly at a top portion height thereof and extending downwardly relative to the top portion height and away from the vertical post assembly; a pair of longitudinal carrier arms mounted at one respective end thereof to another end of the longitudinal mounting arm opposite the one end, the pair of longitudinal arms extending away from the longitudinal mounting arm and from each other and extending rearwardly relative to the another end of the longitudinal mounting arm towards the vertical post assembly, the carrier arms defining a respective free end thereof being opposite the one respective end thereof; and at least one hanger element for mounting articles thereto to be displayed, the at least one hanger element being movably mounted to one of the pair of longitudinal carrier arms so as to be movable along a longitudinal length of the carrier arm, the at least one hanger element extending away from the longitudinal carrier arm.

In accordance with an aspect of the present disclosure, there is provided a kit for a display rack for displaying articles, the kit comprising: a base for being positioned on a surface; a vertical post assembly for being mounted to the base at a bottom portion thereof and upstanding therefrom and defining a top portion thereof; at least one article holding assembly for being removably mounted to the vertical post assembly at the top portion thereof, the article holding assembly comprising: a longitudinal mounting arm mounted at one end thereof to the vertical post assembly at a top portion height thereof and extending downwardly relative to the top portion height and away from the vertical post assembly; a pair of longitudinal carrier arms mounted at one respective end thereof to another end of the longitudinal mounting arm opposite the one end, the pair of longitudinal arms extending away from the longitudinal mounting arm and from each other and extending rearwardly relative to the another end of the longitudinal mounting arm towards the vertical post assembly, the carrier arms defining a respective free end thereof being opposite the one respective end thereof; and at least one hanger element for mounting articles thereto to be displayed, the at least one hanger element being movably mounted to one of the pair of longitudinal carrier arms so as to be movable along a longitudinal length of the carrier arm, the at least one hanger element extending away from the longitudinal carrier arm.

In accordance with an embodiment, each carrier arms extends upwardly from the one respective end thereof to the free end thereof.

In accordance with an embodiment, the vertical post assembly comprises three side by side post members defining two outer post members and a middle post member interposed therebetween, the at least one article holding assembly being mounted to one of the outer post members, and a second article holding assembly being mounted to the other one of the outer post members. In accordance with an embodiment, the vertical post assembly comprises two additional post members positioned on opposite sides of the middle post, a respective additional article holding assembly mounted to each of the two additional post members. In accordance with an embodiment, the middle post is vertically extendible. In accordance with an embodiment, the middle post is configured to receive an auxiliary part.

In accordance with an embodiment, the top portion of the vertical post assembly comprises an extendible portion.

In accordance with an embodiment, the top portion of the vertical post assembly provides for receiving one or more auxiliary parts. In accordance with an embodiment, the one or more auxiliary parts is selected from the group consisting of: a shelf, an extension, a sign, a hanger and any combination thereof.

In accordance with an embodiment, the hanger element comprises a mounting portion for being slidably mounted to the carrier arm.

In accordance with an embodiment, the mounting portion comprises a tab for receiving sign holding element.

The display rack allows to remove and replace hanger elements from the carrier arms without disassembling the whole rack.

The angle of the carrier arms always allows for a waterfall effect. The upward angle of the carrier arm, upwardly extending towards its free end always allows for a double waterfall effect. For example, if the carrier arm carries two or more hanger elements, the hanger element closest to the free end is higher than the preceding hanger element.

The display rack provides for selectively adding auxiliary parts at the top portion of the display rack defined by the top portion of the vertical post assembly.

The display rack provides interchangeable parts without having to dismantle the complete rack.

The display rack provides for displaying a great number of articles such as clothes. When mounting two of the article holding assemblies to the vertical post assembly, the display rack provides four displaying sides. When mounting four of the article holding assemblies to the vertical post assembly, the display rack provides eight displaying sides.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated, in accordance with an aspect of the present disclosure, there is provided a display rack for displaying articles comprising a base, a vertical post assembly mounted to the base and upstanding therefrom and at least one article holding assembly removably mounted to the vertical post assembly. The article holding assembly comprises a longitudinal mounting arm extending downwardly and away from the vertical post assembly. A pair of longitudinal carrier arms are mounted to the longitudinal mounting arm and extend rearwardly and away from the longitudinal mounting arm and from each other. At least one hanger element is movably mounted to one of the pair of longitudinal carrier arms and extends away from the carrier arm. The hanger element is movable along a longitudinal length of the carrier arm. The hanger element provides for mounting articles thereto to be displayed.

With respect to the Figures, a non-restrictive illustrative embodiment of the present device and kit will be discussed.

Figure 1:
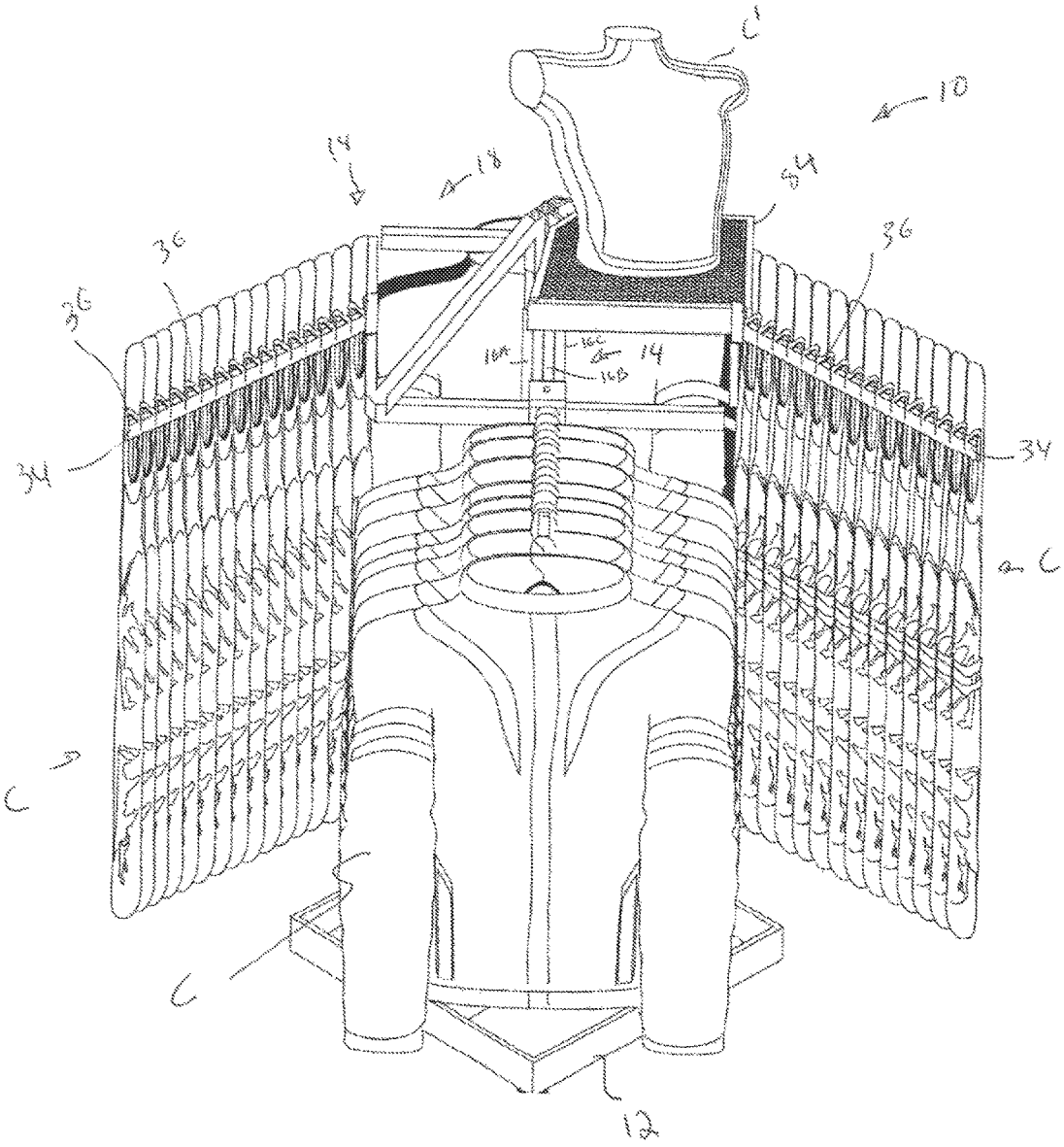
FIG. 1 is a perspective view of a configuration of the display rack of the present disclosure in accordance with a non-restrictive illustrative embodiment thereof.
Figure 2:
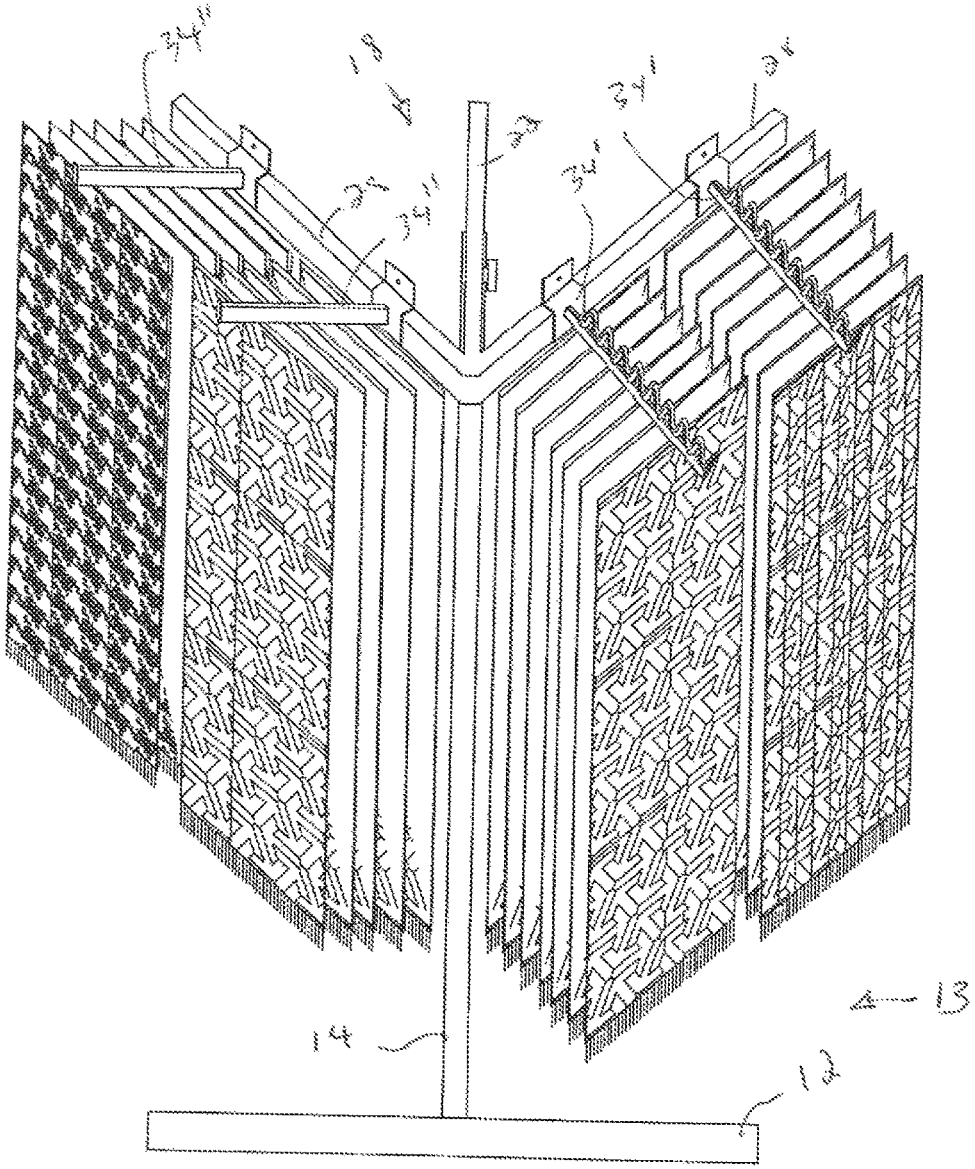
FIG. 2 is a front view of another configuration of the display rack of the present disclosure in accordance with a non-restrictive illustrative embodiment thereof.

FIGS. 1-6 show a display rack 10 including a base structure 12 with a vertical post assembly 14 upstanding therefrom from its bottom portion 13 (see FIG. 2) and extending towards its top portion 15 (see FIG. 2). In this non-limiting example, the vertical post assembly 14 includes three posts 16A, 16B, 16C. Posts 16A and 16C are outer posts and post 16B is a middle post interposed between the outer posts 16A and 16C. Of course, one, two, three or more side by side posts can be contemplated within the context of the present disclosure.

An article holder assembly 18 extends from an upper area near the top 20 (see FIG. 5) of the vertical post assembly 14 (and thereby of a given post 16A or 16C).

Figure 6:
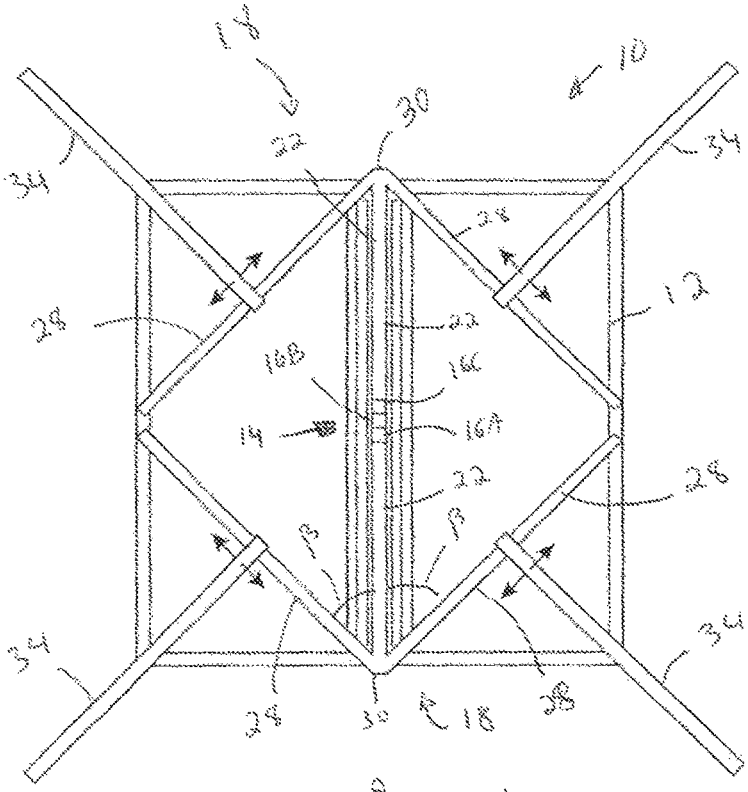
FIG. 6 is a top view of yet a further configuration of the display rack of the present disclosure in accordance with a non-restrictive illustrative embodiment thereof.

In the non-limiting example of FIGS. 1 and 6, there are two article holder assemblies 18 respectively extending from the top 20 of post 16A and 16C. In the non-limiting examples of FIGS. 2, 3, 4, and 5, only one article holder 18 assembly extends from the vertical post assembly 14.

With particular reference to FIGS. 6, and 10-13, the article holder 18 comprise a mounting arm 22 including a mounting portion 24 at one end 26 thereof and a pair of carrier arms 28 laterally and rearwardly (relative to the mounting arm 22) extending from the other end 30 of the mounting arm 22. The carrier arms 28 are therefore angled away from the mounting arm 22. In on embodiment, the carrier arms 28 are angled away at right angles to each other. In an embodiment, the carrier arms are in a horizontal plane when the article holder assembly 18 is mounted to the vertical post assembly 14. However, the carrier arms 28 could also be in the same plane at the mounting arm 22. Of course, the mounting arm 28 may include only one carrier arm 28. The mounting portion 24 defines a receiving sleeve 32 receives the top end 20 of a post 16A or 16C. The mounting element 24 can also include a top hole 31 for receiving an auxiliary element such as a sign holder (see 42 in FIG. 16 for example).

When the article holder assembly 18 is mounted the top 20 of the vertical post assembly 14, the mounting arm is 22 is configured to extend away from the vertical post assembly 14 and to downwardly slope between its ends 26 and 30.

In one non-limiting example, the mounting arm forms an angle α (see FIG. 5) of about 30 degrees with the top plane P defined by the mounting portion 24. In one non-limiting example, the mounting arm 22 forms an angle β (see FIGS. 4 and 6) of about 45 degrees with each carrier arm 28.

As shown in FIGS. 1-6 and 8-10, each carrier arm 28 carries an elongated hanger element 34. Each hanger element 34 extends away from the carrier arm 28, the mounting arm 22 and from each other. In an embodiment, the hanger element 34 is centrally located along the length of the carrier arm 28 it is mounted to. In an embodiment, the hanger element 34 extends at right angles to the carrier arm 28 it is mounted to.

As will be further discussed below, the hanger elements 34 can be in the same plane as the carrier arms 28 they are mounted to, alternatively the hanger elements 34 can be angled downwardly (see hanger elements 34' in FIG. 2) or upwardly (see hanger elements 34" in FIG. 2) from the carrier arms 28.

In an embodiment, the hanger elements 34 is adjustable (e.g. slidable adjustment) along the length of the carrier arm 28 as shown in FIG. 6. The hanger elements 34 can be locked into a selected position along the length of the carrier arm 28 are mounted to. Moreover, each carrier arm 28 can carry more than one hanger element 34. For example, FIG. 2 shows the carrier arm 28 carrying two hanger elements 34.

Figure 8:
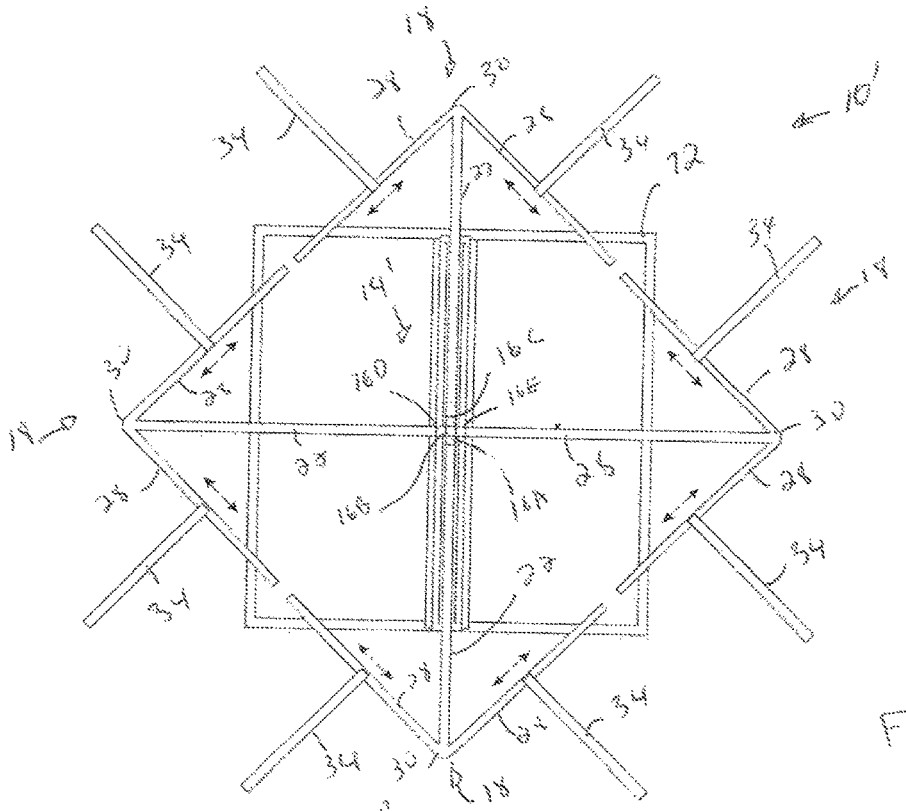
FIGS. 8 and 9 are the same top view of a configuration of the display rack of the present disclosure in accordance with a further non-restrictive illustrative embodiment thereof.
Figure 9:
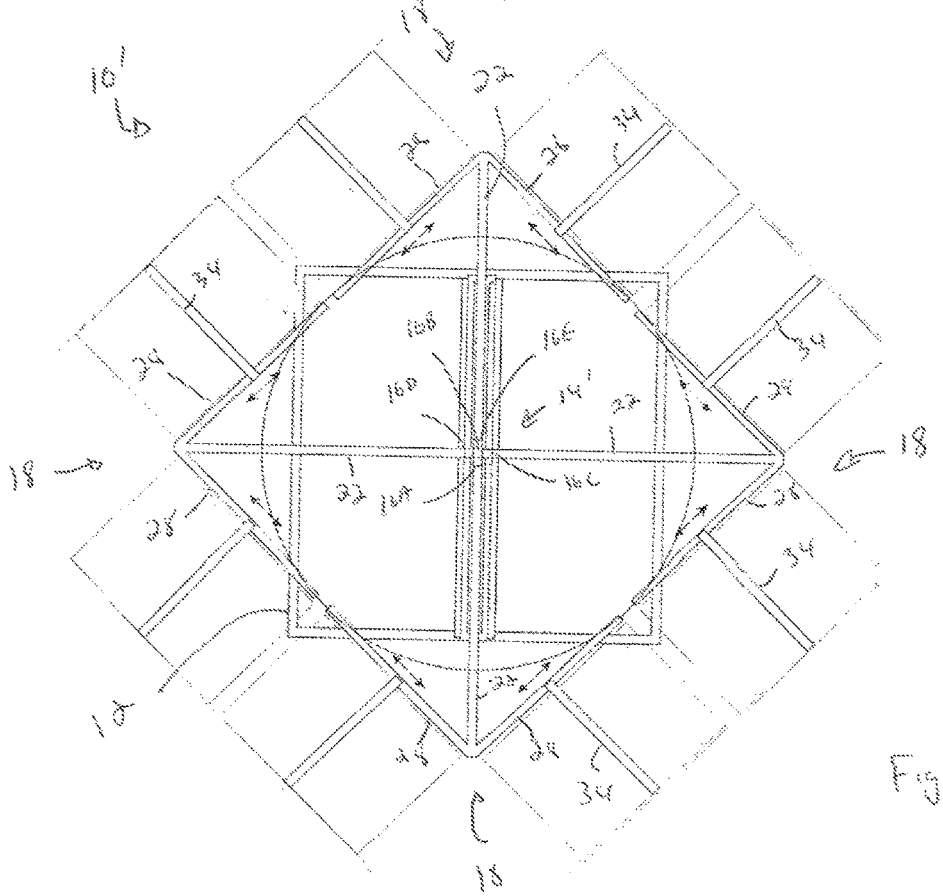
Figure 10:
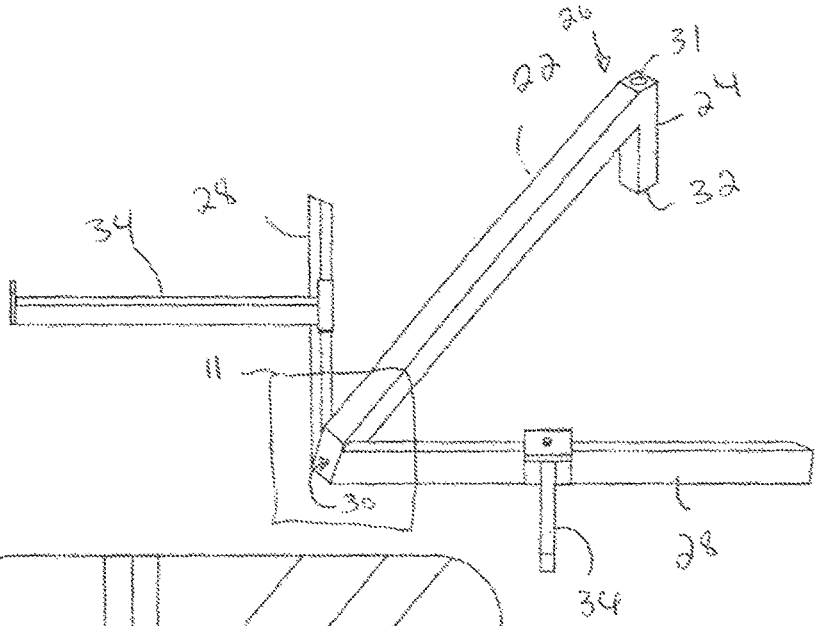
FIG. 10 is a perspective view of the article holding assembly of the display rack of the present disclosure in accordance with a non-restrictive illustrative embodiment thereof.
Figure 11:
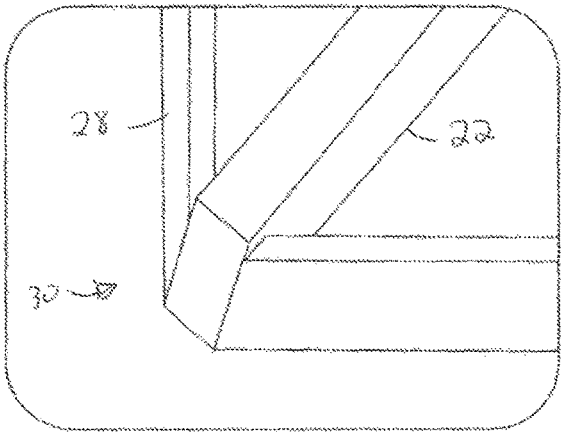
FIG. 11 is an enlarged view of the circled portion 11 of FIG. 10.
Figure 12:
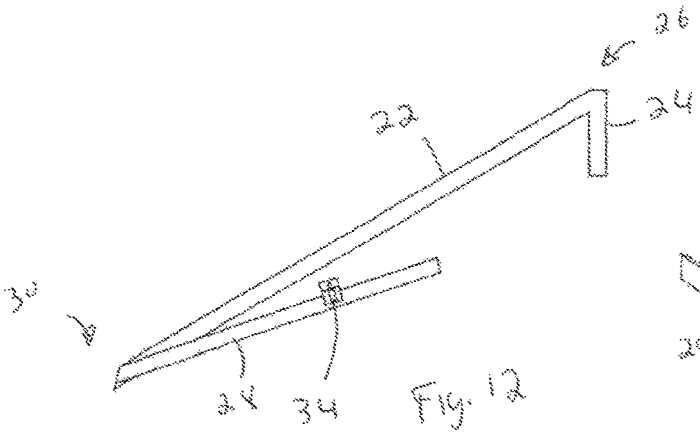
FIG. 12 is a side view of the article holding assembly of FIG. 10.
Figure 13:
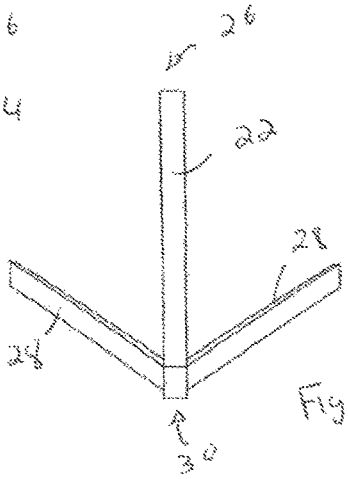
FIG. 13 is front view of the article holding assembly of FIG. 10 without the hanger elements.
Figure 19:
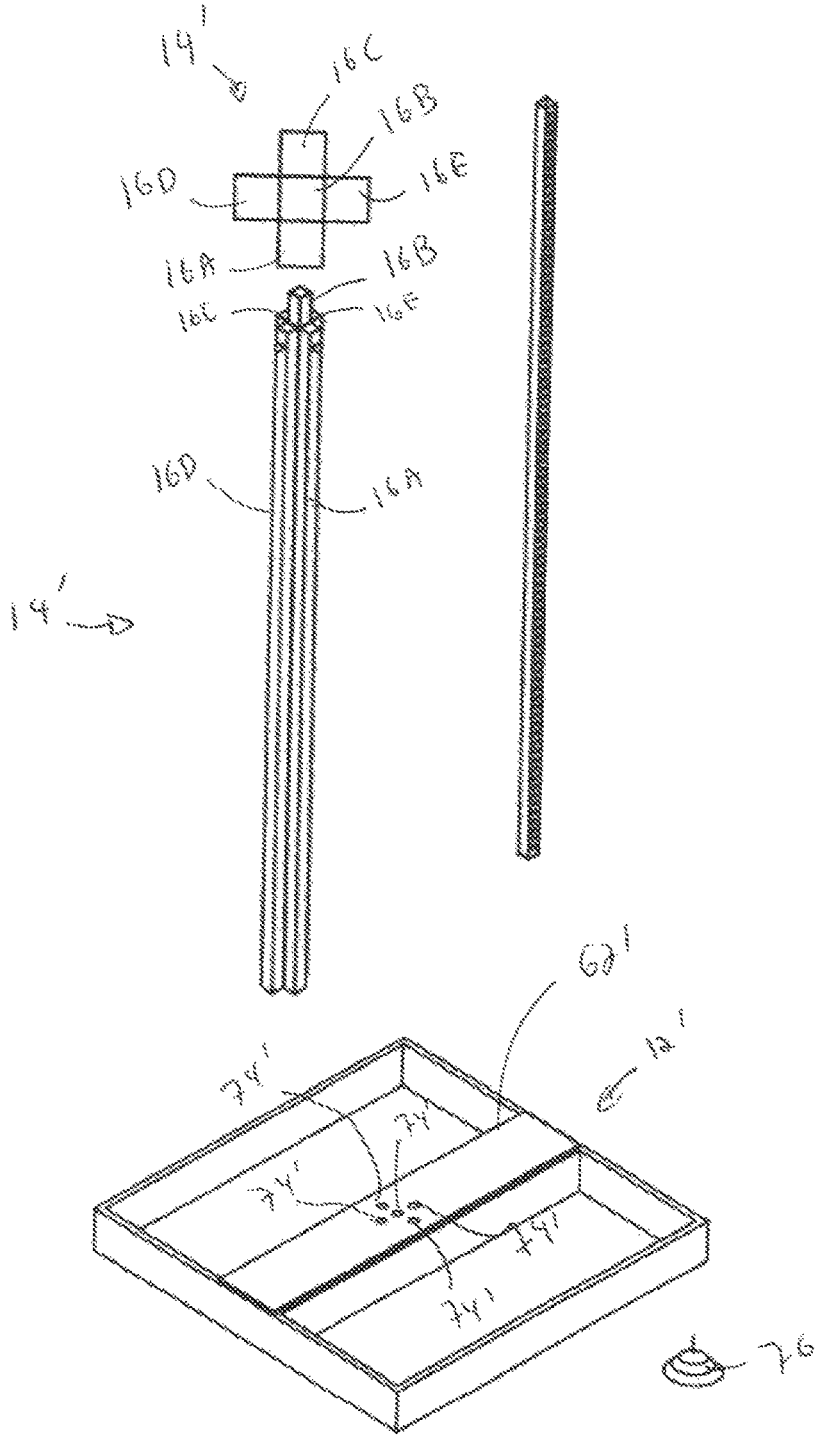
FIG. 19 is a perspective exploded view of the vertical post assembly and components thereof of the display rack of the present disclosure in accordance with another non-restrictive illustrative embodiment thereof.

With respect to FIGS. 8, 9 and 19, there is shown a display rack 10' similar to display rack 10. Display rack 10' includes a vertical post assembly 14' with five post members 16A, 16B, 16C and 16D. The foregoing post members are arranged in a cross configuration one straight line being formed along one axis by outer posts 16A and 16C with middle post 16B interposed therebetween (as in Display rack 10) and another straight line being formed along another axis perpendicular to the foregoing one axis by outer posts 16D and 16E and again with the same middle post 16B interposed therebetween. As such, each outer post 16A, 16C, 16D and 16E can receive an article holder assembly 18. FIGS. 8 and 9 show that the display rack 10' includes four article holder assemblies 18 each being mounted to a respective post 16A, 16C, 16D and 16E. Like in display rack 10, FIGS. 8 and 9 show that the hanger elements 34 are slidably adjustable along the carrier arms 28 of the shows that the two ore more hanger elements 34 can be selectively positioned along the length of their respective carrier arms 34.

Figure 3:
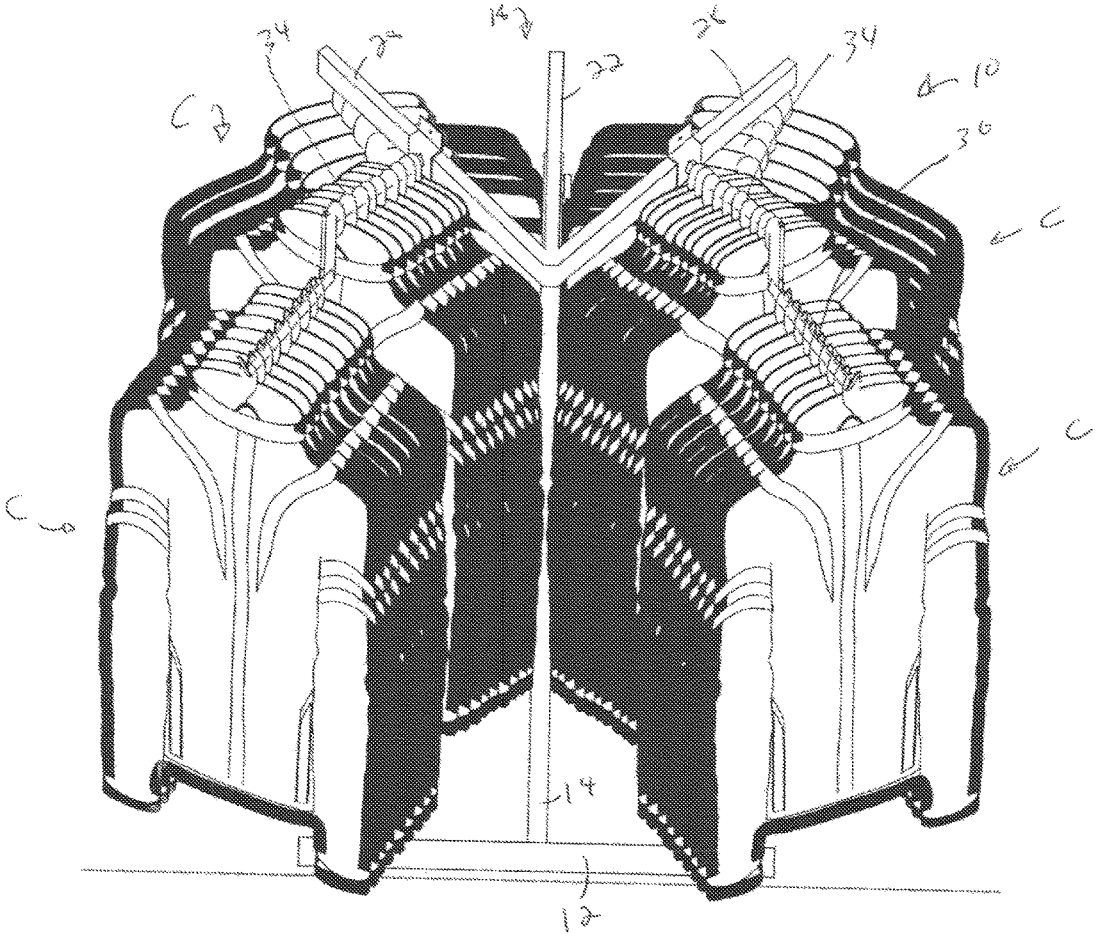
FIG. 3 is a front view of a further configuration of the display rack of the present disclosure in accordance with a non-restrictive illustrative embodiment thereof.

As shown in FIGS. 1, 2, and 3, the hanger elements 34 (including elements 34' and 34") include hooks, generally denoted 36 for hanging articles such as clothes C. The hooks 36 can extend from the top of the hanger elements (such as for hanger elements 34' in FIG. 2) of from the bottom of the hanger elements (such as for hanger elements 34" in FIG. 2). Of course, the hooks along the hanger elements 34 can be positioned in a variety of suitable ways within the scope of the present disclosure as can be contemplated by the skilled artisan.

Figure 14A:
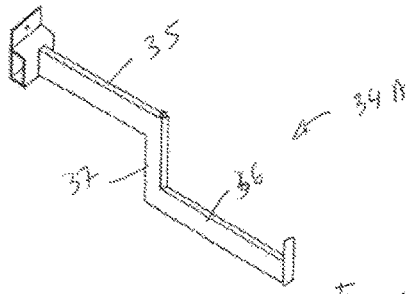
FIGS. 14A, 14B, 14C, 14D, and 14E are side perspective views of respective non-restrictive illustrative embodiments of hanger elements of the display rack of the present disclosure.
Figure 14B:
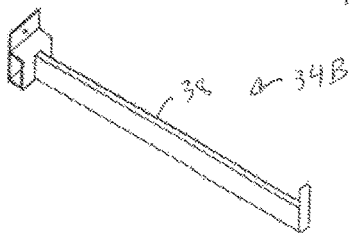
Figure 14C:
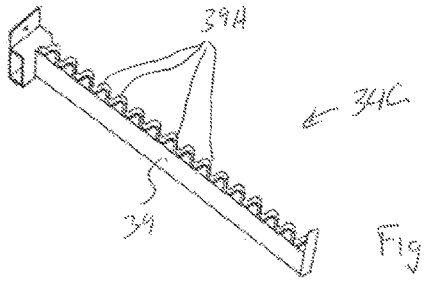
Figure 14D:
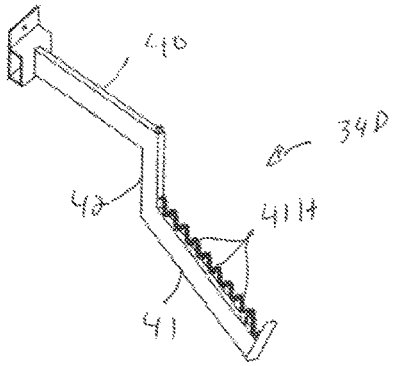
Figure 14E:
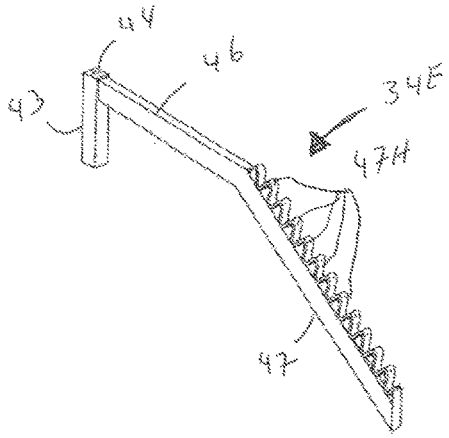

Turning now to FIGS. 14A-14E, various non-limiting example of hanger elements are shown. FIG. 14A shows hanger element 34A which comprises multi-level hook bodies 35, 36 connected by a vertical connector 37 therebetween. FIG. 14B shows a hanger element 34B with a straight hook 38. FIG. 14C shows a hanger element 34C which has a waterfall configuration including ripple hooks 39H along its hook body 39. FIG. 14D shows a hanger element 34D comprising a waterfall configuration and including a multi-level hook bodies 40 and 41 connected by a vertical connector 42 therebetween. Hook body 41 includes ripple hooks 41H. FIG. 14E shows a hanger element 34E which includes a post mounting element 43, which in this example is shown as a square tubing with a threaded insert sleeve 44 for receiving a sign holder 45 (see FIG. 16). Hanger element 34D provides an extended waterfall configuration for posts and includes a rear extended portion 46 extending from the post mounting element 43 and a forward waterfall section 47 forming an angle with the rear portion 46 and including ripple hooks 47H.

It should be noted that the hanger elements shown here are non-limiting examples and that other suitable hanger elements such as panels, tabs and other desirable structures and configurations can be contemplated within the context of the present disclosure.

Figure 16:
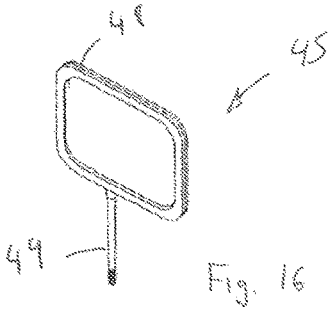
FIG. 16 is perspective view of a sign holder of the display rack in accordance with a with a non-restrictive illustrative embodiment of the present disclosure.

With respect to FIG. 16, the sign holder 45 includes an insert slot 48 and a threated stem 49 for being inserted into the threaded insert sleeve 44.

Figure 15A:
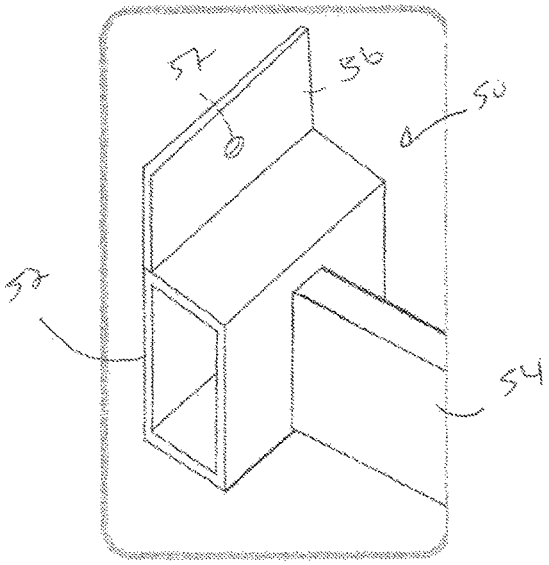
FIG. 15A is a perspective view of a mounting end of the hanger element of the display rack in accordance with a non-restrictive illustrative embodiment.
Figure 15B:
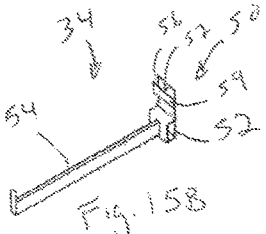
FIG. 15B is a perspective view of a hanger element of the display rack in accordance with a non-restrictive illustrative embodiment of the present disclosure.
Figure 15C:
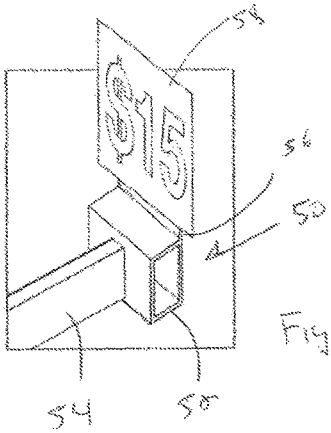
FIG. 15C is a perspective view of a mounting end of the hanger element of the display rack of the present disclosure in accordance with another non-restrictive illustrative embodiment thereof.

FIGS. 15A, 15B, and 15C show the slider mounting end 46 of the hanger elements 34. The slider mounting end 50 includes a slider sleeve 52 for being slidably mounted to a carrier arm 28, a hanger main body 54 extends from the slider sleeve 52. The slider sleeve 52 is configured to be locked into position along the carrier arm 28 via a locking fastener such a screw fitted into a hole defined by the slider sleeve 52. Of course, other locking techniques known in the art can also be contemplated within the context of the present disclosure to lock the hanger element 34 along the carrier arm 28. A tab 56 upwardly extends from the slider sleeve 52 and includes a hole 57. The tab 56 can be used for receiving price signs 58 (see FIG. 15C) or other auxiliary elements. The signs 58 or auxiliary elements may be fastened to the tab 56 via the hole 57, via magnetic connection, via adhesive connection, the signs 58 or auxiliary elements may include clips for being clipped to the tab 56. FIG. 15B shows that the tab 56 includes a clipping element 59 for clipping signs 58 or auxiliary elements thereto.

Of course, the skilled artisan can contemplate a variety of other suitable ways to attach elements for various purposes along any portion of the body defined by the hanger elements 34 and 34A-34D as illustrated and other suitable hanger element types discussed above.

Figure 17:
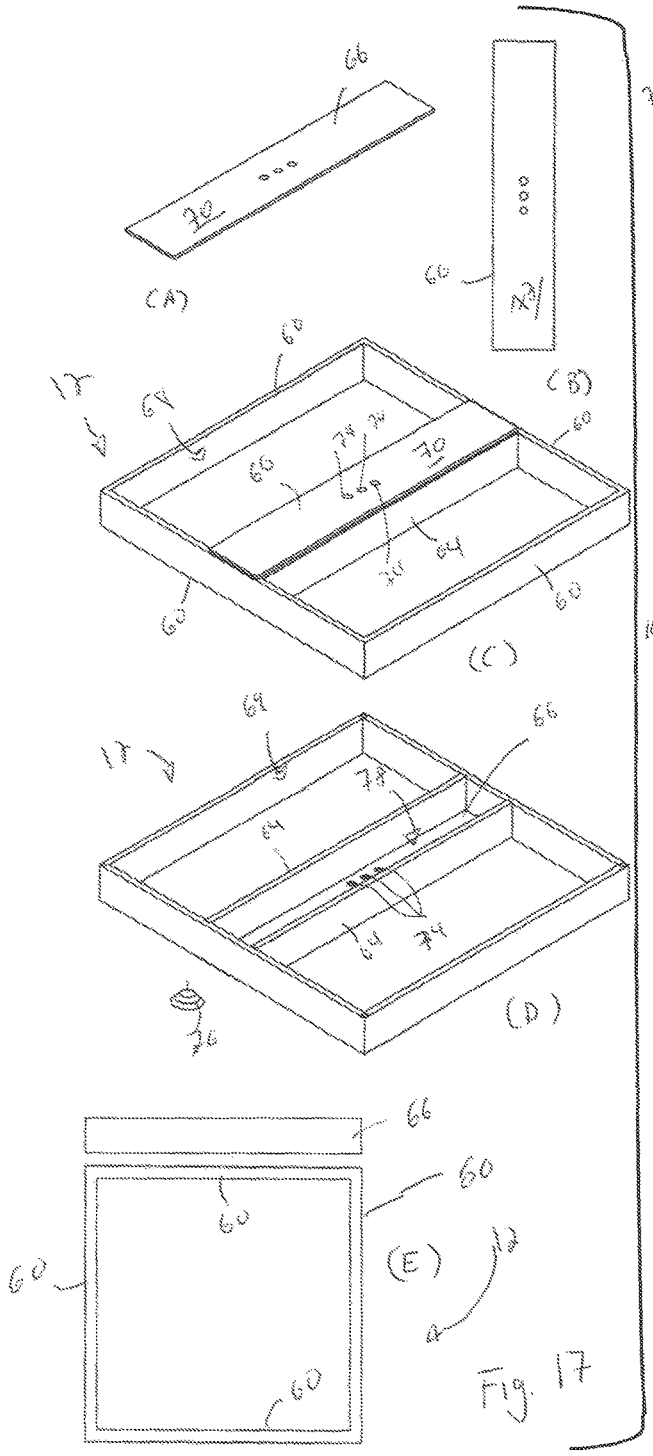
FIG. 17 shows perspective views of the base and components thereof of the display rack of the present disclosure in accordance with another non-restrictive illustrative embodiment thereof.

Turing now to FIG. 17 there is shown the base 12 in (C) and (D) which has a generally rectangular configuration. The rectangular base 12 includes lateral four lateral sides 60, with a median structure 62 extending between any two opposite lateral sides 60. The median structure 62 defines a longitudinal rectangle having side panels 64 and a top panel 66 at the top surface area 68 of the base 12 as shown in (C), the median structure is open at the bottom surface area 69 of the median structure as shown in (D). The top panel 66 has a top surface 70, see (A) and (C) and a bottom surface 72, see (B) and (D). In another embodiment shown in (E), the median structure panel 62 only includes a top panel 66 that is mounted to the base structure 12. The top panel 66 includes three holes 74 for attaching each of the posts 16A, 16B and 16C thereto via an undersurface fastener 76 threaded to the posts from the open bottom face 69 of the base 12.

Figure 18:
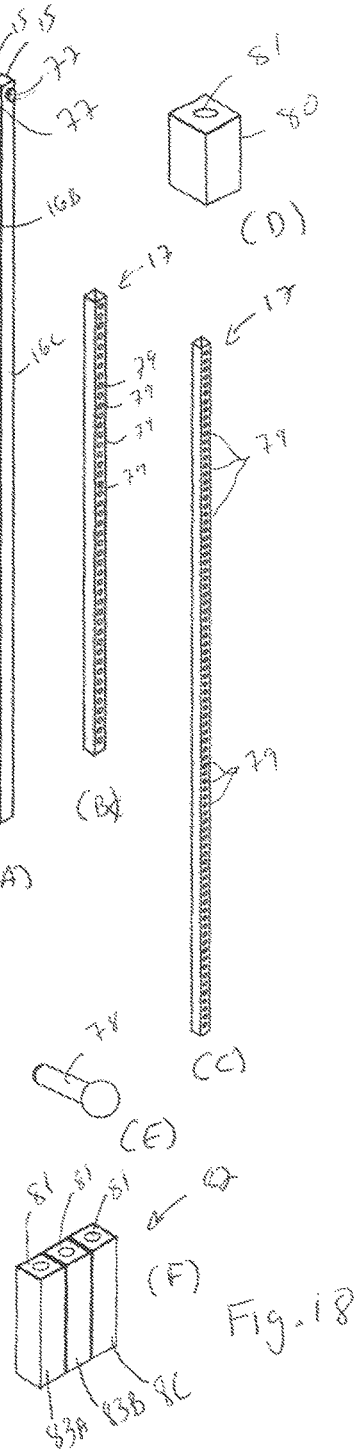
FIG. 18 is a perspective exploded view of the vertical post assembly and components thereof of the display rack of the present disclosure in accordance with a non-restrictive illustrative embodiment thereof.

FIG. 18 shows the vertical post assembly 14 including posts 16A, 16B and 16C shown in (A). The post 16B receives longitudinally adjustable post elements 17 of varying heights shown in (B) and (C) which are adjusted along a desired height and locked into place by a locking peg 78 shown in (E) for pegging the posts 17 at a selected notch 79 formed along the length thereof and aligned with a post notch 77. Since all three posts 16A, 16B or 16C are tubular and provide an open top end 15, any one of the posts can receive an adjustable post element 17. As such, the top ends of the mounting elements of the arms 22 can be open to allow posts 17 to extend therethrough thus fastening of the article holder assembly 18 on the vertical post assembly can be provided by clamping and the like. A post cap square tube 80 shown in (D) can be mounted to any one of the posts 16A, 16B or 16C and includes a threaded insert sleeve 81 for receiving a sign holder 45 or other auxiliary element. A triple post cap 82 shown in (F) can be mounted to all three posts simultaneously as it forms three square tube sleeves 83A, 83B and 83C, one for each post 16A, 16B and 16C, respectively. Each tube sleeve 83 includes a top hole 81.

Figure 4:
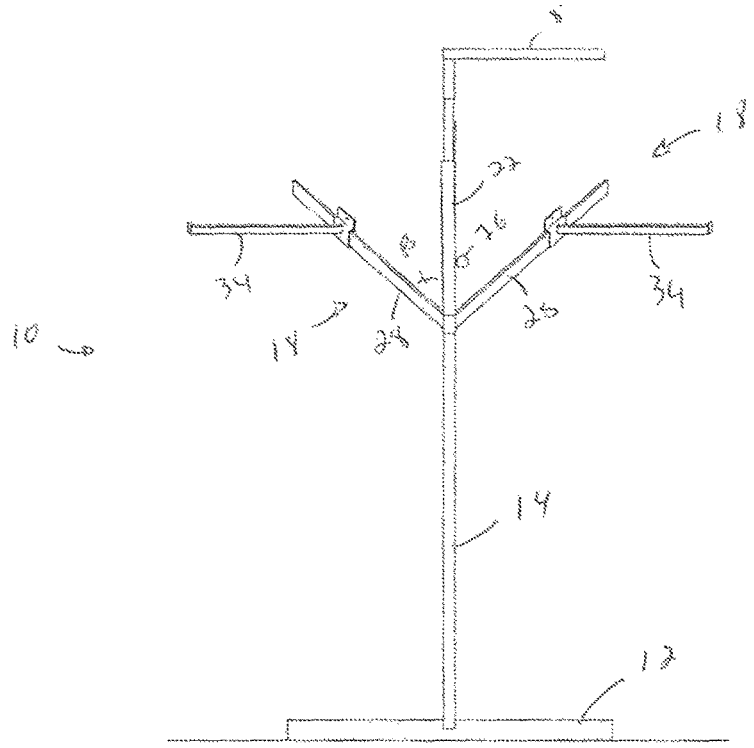
FIG. 4 is a front view yet another configuration of the display rack of the present disclosure in accordance with a non-restrictive illustrative embodiment thereof.
Figure 5:
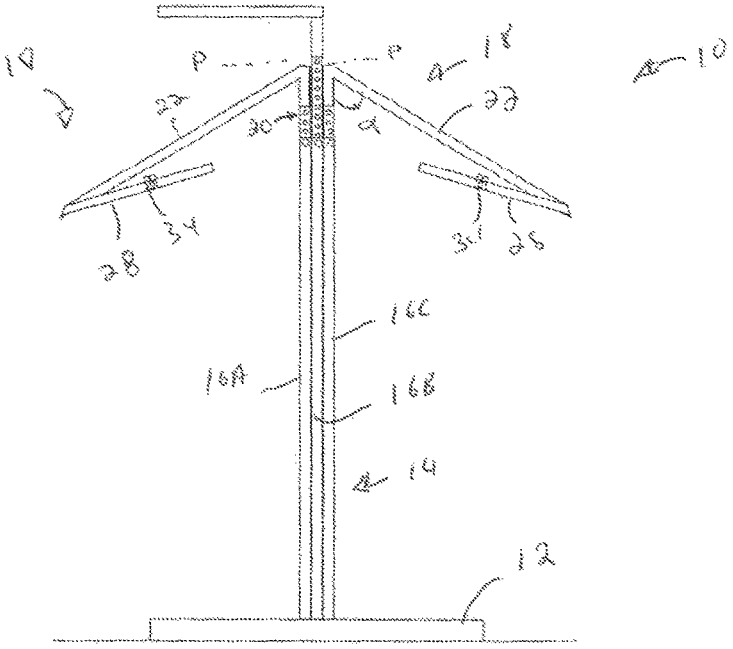
FIG. 5 is a side view of the configuration of the display rack shown in FIG. 4.

The adjustable posts 17 can be capped by a variety of auxiliary elements as previously discussed and as will be further discussed below. For example, FIGS. 1, 4 and 6 show an accessory part 84 mounted to the extending post 17 of median post 16B. In this non-limiting example, the accessory part 84 is a shelf and can hold an article (such as C' in FIG. 1).

Turning now to FIG. 19, there is shown the vertical post assembly 14' previously discussed. The median member 16B receives the adjustable post element 17. Alternatively, posts 16A, 16C, 16D, and 16E can also receive an adjustable post. The base 12' shown in FIG. 19 includes median structure 62' with five receiving holes 74' positioned in the same cross configuration as the posts 16A, 16B 16C, 16D, and 16E of the vertical post assembly 14' to be fastened thereto via the underside fastener 76 (as explained for base 12 in FIG. 17).

Figure 7:
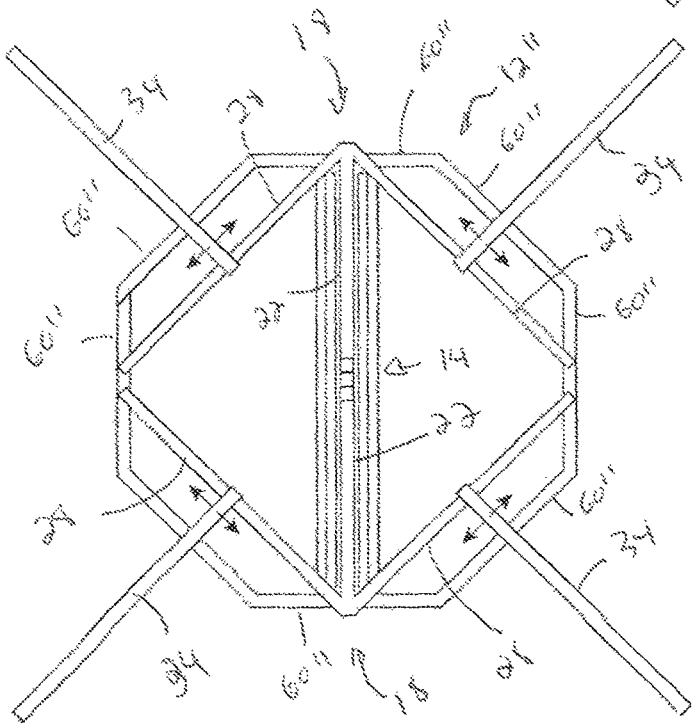
FIG. 7 is a top view of a configuration of the display rack of the present disclosure in accordance with another non-restrictive illustrative embodiment thereof.

Turning back to FIG. 7, there is shown a display rack 10" similar to display rack 10 with the main difference being that the base 12" comprises an octagonal shape with eight lateral sides 60".

Of course, the bases of the present disclosure can be provided in a variety of shapes, structures, sizes and configurations within the scope of the present disclosure as can be contemplated by the skilled artisan.

Figure 20:
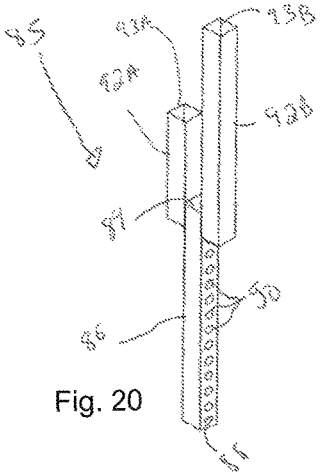
FIG. 20 is a perspective view of a post adaptor of the display rack of the display rack of the present disclosure in accordance with a non-restrictive illustrative embodiment thereof.

FIG. 20 shows a reversible two-in-one post adapter 85 having a central square tube 86 with an open bottom end 88 and a closed top end 88 and with holes 90 on its opposite sides for height adjustment locking. The central tube 86 has two lateral tubes 92A and 92B of differing heights without holes and having open respective top ends 93A and 93B. The adapter 85 can be mounted to the vertical post structures 14 or 14' provided herein.

Figure 21B:
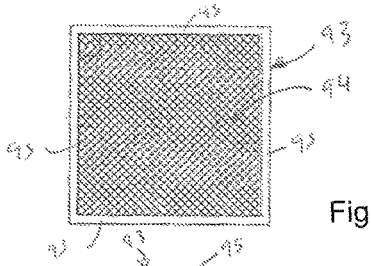
FIG. 21B is a top view of the shelf of FIG. 21A.
Figure 21C:
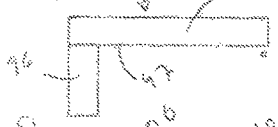
FIG. 21C is a side view of the shelf FIG. 21A.
Figure 21A:
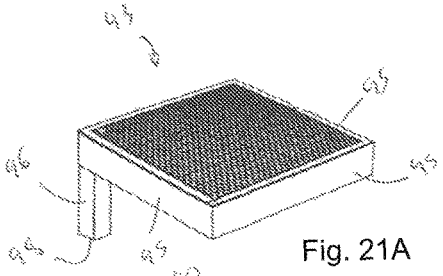
FIG. 21A is a perspective view of a shelf of the display rack of the display rack of the present disclosure in accordance with a non-restrictive illustrative embodiment thereof.
Figure 22B:
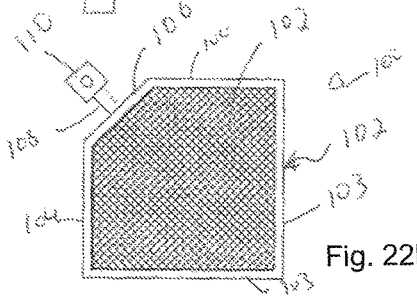
FIG. 22B is a top view of the shelf of FIG. 22A.
Figure 22A:
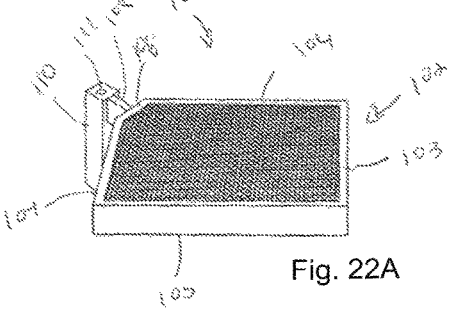
FIG. 22A is a perspective view of a shelf of the display rack of the display rack of the present disclosure in accordance with another non-restrictive illustrative embodiment thereof.
Figure 22C:
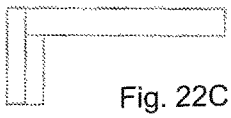
FIG. 22C is a side view of the shelf FIG. 22A.

FIGS. 21A, 22B and 22C show an accessory part in the form of a square shelf 93 comprising a top shelf surface 94 in the form of a screen mesh surface bounded by four lateral side panels 95. The shelf 93 includes a tube 96 extending from its underside 97 and positioned at a corner thereof. The tube 96 forms a sleeve 98 for receiving therein a portion of the vertical post assembly 14 or 14' which is usually the middle post 16B but can be one of the other posts described herein.

FIGS. 22A, 22B and 22C show another a diagonal shelf 100 having a shelf body 101 defining a top screen mesh surface 102 with two similar lateral sides 103 and two opposite and similar lateral sides 104 which are truncated but joined by a diagonal surface side 106 therebetween. A bridge 108 extends from the diagonal surface side 106 and connects a tube 110 (including a top insert hole 111) to the shelf body 102.

Figure 23:
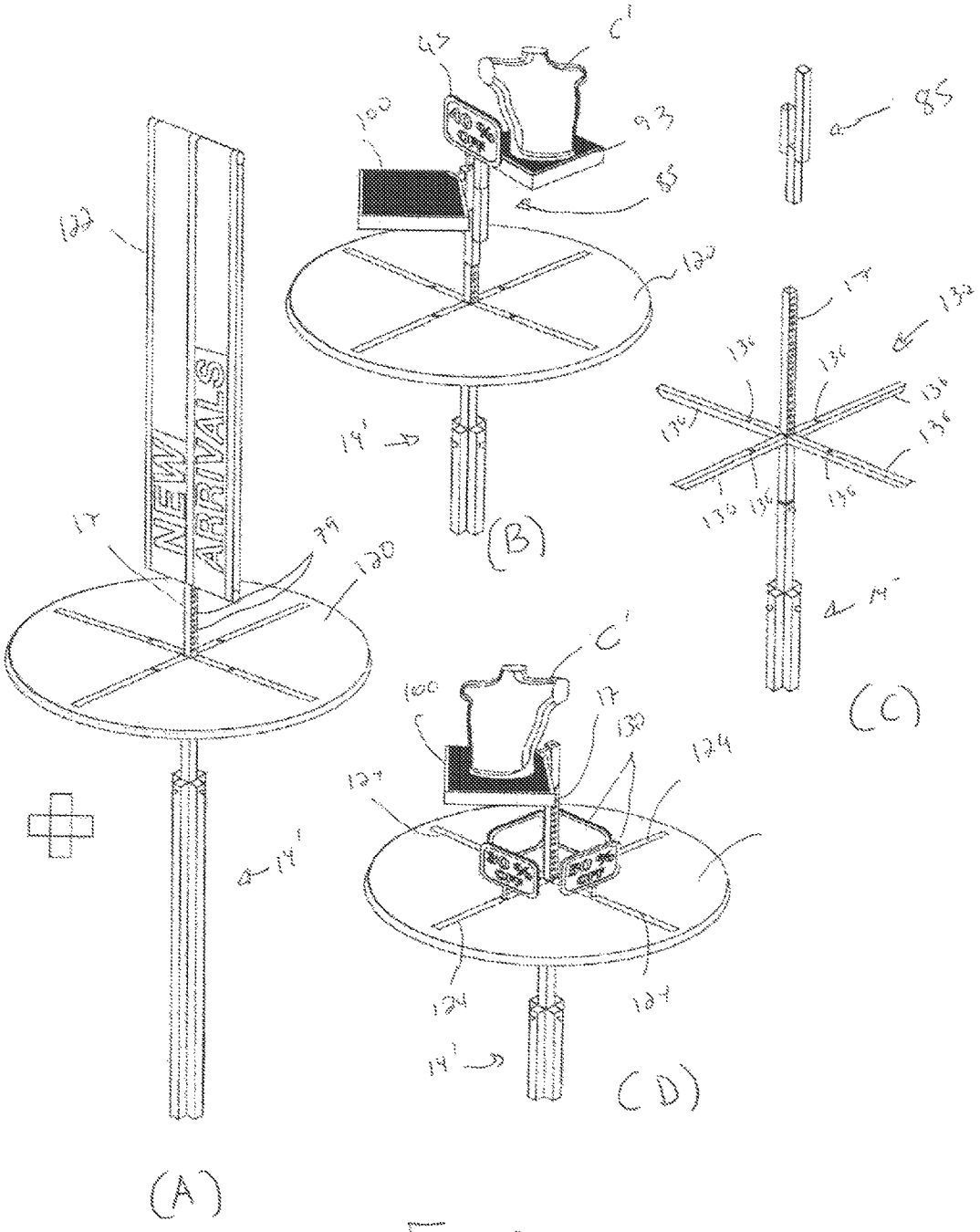
FIG. 23 show perspective view of various configurations of auxiliary parts mountable to the display rack of the present disclosure in accordance with non-restrictive illustrative embodiments thereof.

FIG. 23 shows a variety of non-limiting auxiliary part configurations. In (A) a post element 17 is mounted to the vertical post assembly 14'. The post element 17' includes a circular shelf 120 mounted thereto and locked in place via a peg 78 in hole 79 beneath the shelf 120. A longitudinal sign holder 122 is also shown mounted to the post element 17. In (B) the longitudinal sign holder 122 is replaced by the adapter 85 which is shown having a shelf 93 (holding an article C' thereon) mounted to post 92B as well as a shelf 100 mounted to post 92A and a sign holder 45 inserted in hole 111 of the shelf 100. In (D), the adapter 85 has been replaced by the shelf 100 directly mounted to the post element 17 and holding an article C' thereon. The circular shelf 120 includes four longitudinal inserts 124 formed on it top surface and extending from its central post receiving hole 128. Small sign holders 130 are positioned in the inserts 124. In (C), the post 17 receives a radial auxiliary part 132 comprising four radially extending rods 134 with small inserts 136. The rods 134 extend from a central tube part 138 mounted to the post 17. The rods 134 can hold a shelf structure thereon or one or more other type of auxiliary part.

The display racks 10, 10', 10" shown herein can be provided in the form of a kit for assembly thereof.

The display racks of the present disclosure provide for displaying two, four six and eight sides. The hanger elements are slidable along the carrier arms and permit for clothing to be shifted to one side or the other side for best visual appeal. The multiple hanger elements make rack changes easy and quick. The V-like formation of the carrier arms on the downwardly sloping mounting arm provide inward angled carrier arms that compensate for the centre supporting arm which slopes at an angle so that the hanger elements are always level with the floor. The display racks of the present disclosure provide numerous presentation techniques.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A display rack for displaying articles comprising:

a base for being positioned on a surface;

a vertical post assembly comprises at least one post, each post having a top portion and a bottom portion, wherein the bottom portion of each post is mounted to the base and extends upwardly therefrom;

a first article holding assembly removably mounted to the top portion of a first post from said at least one post, the first article holding assembly comprising:

a vertical mounting portion having a bottom end that matingly engages the top portion of the first post, a mounting arm that extends diagonally downward from a top portion of the vertical mounting portion;

a pair of carrier arms each having an inner end and an opposite outer end, wherein the inner ends of the pair of carrier arms are mounted to a distal end of the mounting arm, the pair of carrier arms each extending away from the mounting arm at approximately a 45 degree angle in opposite directions, the outer ends of the pair of carrier arms each defining a respective free end, wherein the mounting arm and the pair of carrier arms combined generally define an arrow shape; and at least one hanger element for mounting articles thereto to be displayed, the at least one hanger element being movably mounted along a longitudinal length of one of the pair of carrier arms, the at least one hanger element extending away from said one of the pair of carrier arms.

2. The display rack according to claim 1, wherein each carrier arm extends upwardly from the respective inner end thereof to the free end thereof.

3. The display rack according to claim 1, wherein the at least one post of the vertical post assembly comprises the first post, a second post, and a third post, wherein the first post and the third post abut the second post which is interposed between the first post and the third post, the first article holding assembly is mounted to the first post, and a second article holding assembly is mounted to the third post.

4. The display rack according to claim 3, wherein the second post is vertically extendible.

5. The display rack according to claim 3, wherein the second post is configured to receive an auxiliary part.

6. The display rack according to claim 1, wherein the vertical post assembly comprises an extendible portion.

7. The display rack according to claim 1, wherein the vertical post assembly is configured to receive one or more auxiliary parts.

8. The display rack according to claim 7, wherein the one or more auxiliary parts is selected from the group consisting of: a shelf, an extension, a sign, a hanger and any combination thereof.

9. A kit for a display rack for displaying articles, the kit comprising:

a base for being positioned on a surface;

a vertical post assembly comprises at least one post, each post having a top portion and a bottom portion, wherein the bottom portion of each post is mounted to the base and extends upwardly therefrom;

a first article holding assembly removably mounted to the top portion of a first post from said at least one post, the first article holding assembly comprising:

a vertical mounting portion having a bottom end that matingly engages the top portion of the first post, a mounting arm that extends diagonally downward from a top portion of the vertical mounting portion;

a pair of carrier arms each having an inner end and an opposite outer end, wherein the inner ends of the pair of carrier arms are mounted to a distal end of the mounting arm, the pair of carrier arms each extending away from the mounting arm at approximately a 45 degree angle in opposite directions, the outer ends of the pair of carrier arms each defining a respective free end, wherein the mounting arm and the pair of carrier arms combined generally define an arrow shape; and at least one hanger element for mounting articles thereto to be displayed, the at least one hanger element being movably mounted along a longitudinal length of one of the pair of carrier arms, the at least one hanger element extending away from said one of the pair of carrier arms.

10. The display rack according to claim 1, wherein the at least one hanger element comprises a mounting portion having a channel therein for slidably mounting the at least one hanger element to said one of the pair of carrier arms.

11. The display rack according to claim 1, wherein the at least one hanger element comprises a mounting portion having a tab for receiving a sign.

* * * * *